United States Patent [19]

Nakamura et al.

[11] 4,414,305

[45] Nov. 8, 1983

[54] IMAGE-FORMING METHOD

[75] Inventors: Koichi Nakamura; Hiroyuki Hirai, both of Kanagawa, Japan

[73] Assignee: Fuji Photo Film Co., Ltd., Kanagawa, Japan

[21] Appl. No.: 402,703

[22] Filed: Jul. 28, 1982

[30] Foreign Application Priority Data

Jul. 28, 1981 [JP] Japan ..... 56-117973

[51] Int. Cl.[3] ..... G03C 5/32

[52] U.S. Cl. ..... 430/373; 430/418; 430/461; 430/469; 430/487; 430/489; 430/490; 430/491; 430/492; 430/943

[58] Field of Search ..... 430/373, 461, 943, 387, 430/469, 487, 418, 489, 490, 491, 492, 376

[56] References Cited

U.S. PATENT DOCUMENTS

| | | | |
|---|---|---|---|
| 4,045,225 | 8/1977 | Shimamura et al. | 430/943 |
| 4,062,684 | 12/1977 | Hara et al. | 430/943 |
| 4,069,050 | 1/1978 | Hara et al. | 430/943 |
| 4,094,682 | 6/1978 | Fujiwhara et al, | 430/943 |
| 4,097,278 | 6/1978 | Bissonette . | |
| 4,113,490 | 9/1978 | Fujiwhara et al. | 430/943 |

FOREIGN PATENT DOCUMENTS 2005431A 4/1979 United Kingdom .

OTHER PUBLICATIONS

Chemical Abstracts, vol. 95, No. 70983h, 1981.

*Primary Examiner*—J. Travis Brown
*Attorney, Agent, or Firm*—Sughrue, Mion, Zinn, Macpeak & Seas

[57] ABSTRACT

An image-forming method is disclosed. The method includes providing a silver halide color photographic material and imagewise exposing that material. The exposed material is color developed in the presence of a compound capable of reacting with or adsorbing a silver halide. The material is developed within a monobath intensifying developing solution which includes hydrogen peroxide or a compound capable of releasing hydrogen peroxide and a color developing agent. The solution substantially excludes the presence of bromide ions and iodide ions. The compound capable of reacting with or being absorbed into silver halide is a nitrogen-containing heterocyclic compound which has been found to be very useful in the image-forming method to obtain high color density with materials containing a small amount of silver halide.

14 Claims, No Drawings

IMAGE-FORMING METHOD

FIELD OF THE INVENTION

This invention relates to a method for using a mono-bath type intensifying developing solution which comprises processing a silver halide photographic color material with a mixed processing solution containing hydrogen peroxide or a compound capable of releasing hydrogen peroxide and a color developing agent to form photographic color images. More particularly, it relates to a method for processing an imagewise exposed silver halide photographic material including photographic couplers and low-content of silver halide (hereinafter they are called low silver containing photographic elements) in a mono-bath type intensifying developing solution. More in detail, it relates to a color image forming method which comprises being subjected to a mono-bath intensifying development without inhibition of development and intensification caused by deactivation, bleaching and dissolving the latent image nuclei and without accompanying with fogs, whereby excellent photographic properties (such as fog, sensitometry tone and maximum color image image density (hereinafter abbreviated as $D_{max}$)) in a short processing time are obtained. The mono-bath type intensifying developing process means that photographic materials are processed with a solution in which hydrogen peroxide or a compound capable of releasing hydrogen peroxide is substantially present in combination with a color developing agent (hereinafter called a mono-bath type intensifying developer).

BACKGROUND OF THE INVENTION

It is well known that silver halide photographic materials are developed and intensified to amplify image-formation. It is described, for example, in Friedman, "History of Color Photography", 2nd Ed., page 406 (1956) that in the presence of a coupler, a paraphenylenediamine color developing agent is oxidized by the decomposition of hydrogen peroxide on the surface of a catalyst followed by coupling it with the coupler to form a dye. Further, various photographic methods utilizing the decomposition of peroxide compounds on the surface of noble metals are described in U.S. Pat. Nos. 674,490, 3,684,511, 3,761,265, 3,765,890, 3,776,730, and 3,817,751 and British Pat. Nos. 1,329,444 and 1,341,719. On the other hand, a color intensifying method employing a cobalt complex on the surface of noble metals is described, for example, in Japanese Patent Application (OPI) Nos. 9728/73, 9729/73, 48130/73, 84229/74, 84240/74, 97614/74, 102340/74 and 102314/74.

Color intensifying methods employing halogenous acids such as chlorous acid are described in Japanese Patent Application (OPI) Nos. 53826/76 and 13336/77. A color intensifying method employing an iodoso compound such as iodoso benzoate is described in Japanese Patent Application (OPI) No. 73731/77.

These compounds which have an intensifying effect such as peroxides, halogenous acids, iodoso compounds and cobalt complex compounds (III) are called intensifying agents and the processing bath which includes the intensifying agent are called an intensifying bath.

Color image intensifying methods which utilize the catalytic action of peroxide compounds or cobalt (III) complex are generally well known. Particularly, the intensification of hydrogen peroxide appears to be most efficient with respect to the amplifying effect. These methods are known as methods of intensifying images which comprises imagewise exposing silver halide photographic materials, forming developed silver nuclei from thus obtained latent image with development, redox-reacting an intensifying agent with a color developing agent on the developed silver nuclei which acts as a catalyst to form an oxidation product of the developing agent, which reacts with a color-forming coupler to produce a colored image with high density. In other words, the intensifying method means that according to the methods that color photographic materials are color developed and then dipped in a intensifying bath, or are developed with black-and-white developing solution, dipped in a color developing solution and finally dipped in an intensifying bath, developed silver nuclei are formed from a latent image by development and a color developing agent is retained in a layer of photographic materials, and thus image is intensified by the redox reaction of the color developing agent retained in photographic materials with the intensifying agent in an intensifying bath on the developed silver nuclei. Therefore, in order to intensify an image with high efficiency, a large amount of developing agent must be retained in a layer of photographic materials to be carried in the intensifying bath. Furthermore, the developing agent must be quickly oxidized with the intensifying agent for a short time on the silver nuclei as a catalyst before the developing agent in a layer is diffused into the intensifying bath.

A specific example employing a developing agent having a hydrophobic property, which is incorporated in a developing solution, is described in U.S. Pat. No. 3,816,134 and Japanese Patent Application (OPI) No. 30333/78. Furthermore, Japanese Patent Application (OPI) Nos. 13335/77 and 19829/78 disclose that fog caused by the intensifier is inhibited without degrading the activity of the catalytic nuclei. Thus, mixing the component of the developing solution into the intensifier is a serious problem of the image intensifying method.

It is inevitable that mixing the intensifying inhibitor into the intensifier lowers the intensifying activity and that the efficiency of the intensifier is changed by the mixture with the developing agent. On the other hand, the intensifying developing process is not desirable because the processing steps can not be simplified due to the use of the intensifying step which is not used in a conventional method one or more processing steps being increased. The simplification of steps is disclosed in U.S. Pat. Nos. 3,847,619 and 3,923,511. These patents disclose that development, intensification and bleach may be carried out in a mono-bath employing a cobalt (III) complex. However, it is difficult to obtain excellent color images in case where the photographic material with a low silver content is developed in a mono-bath type intensifying developing solution employing cobalt (III) complex because of fog caused by the intensification and low image density. These technics are extremely important and useful in making economical use of silver resources, because developed silver is used as a catalyst and high image density is obtained with a small amount of silver.

However, the image intensifying method using hydrogen peroxide which has excellent amplifying efficiency has not yet been put into practice. It has not been practically utilized because of problems such as: (1) an increased number of processing baths are needed as described above and accordingly, the processes are not simplified compared with the conventional method; (2) color mixing and fog occur in the photographic materials; and (3) the intensifying activity decreases with the passage of time. This is caused by the presence of components of the developing solution (for example, halogen ion color developing agent, etc.) are included in the intensifying solution by photographic materials. It should also be noted that reproducibility of the images by intensifying solution is very difficult, because intensifying solution is very unstable with the passage of time.

German Pat. No. 1,813,920, and Japanese Patent Application (OPI) Nos. 13335/77 and 127555/80 disclose that development and intensification are carried out in a mono-bath at the same time using hydrogen peroxide. However, although hydrogen peroxide is added in a conventional color developing solution, a mono-bath intensifying developing effect can hardly be obtained in photographic materials having a low silver content because potassium bromide (usually potassium bromide is added in an amount of several hundreds mg/l) is present in the color developing solution as described hereinbefore. Further, when a nitrogen-containing heterocyclic compound type organic anti-foggant is not present in a mono-bath developing intensifying solution a great deal of fog is created. However, the effects of a mono-bath intensifying solution as obtained in this invention can not be obtained by only mixing a conventional color developing agent with hydrogen peroxide.

SUMMARY OF THE INVENTION

An object of this invention is to provide an image-forming method using color photographic materials having extremely low silver content.

Another object of this invention is to provide an image-forming method capable of color intensification with high amplification.

Yet another object of this invention is to provide a color intensifying developing solution which results in a very reduced amount of fog being formed.

Still another object of this invention is to provide an image-forming method of color intensification which makes use of a reduced number of processing baths.

These and other objects of this invention can be attained by the image-forming method which comprises color-developing imagewise exposed silver halide color photographic materials in the presence of a compound capable of reacting with or being absorbed into a silver halide with a mono-bath type intensifying developing solution (the solution includes hydrogen peroxide or a compound capable of releasing hydrogen peroxide and a color developing agent and does not substantially include a bromide ion and an iodide ion).

DETAILED DESCRIPTION OF THE INVENTION

The amount of the color developing agent to be added in this invention is generally at least $10^{-3}$ mol/l and preferably from $2\times10^{-3}$ to $10^{-1}$ mol/l. Hydrogen peroxide is to be added generally in an amount of from 0.5 to 200 mol, preferably from 1 to 80 mol per mol of the color developing agent. A bromide ion and an iodide ion are preferably not incorporated, but may be present in an amount such as $2\times10^{-4}$ mol/l.

The theoretical reason is not clear, but it is understood that the mono-bath developing intensifying solution utilizing hydrogen peroxide may influence fogged nuclei of silver halide and/or the compounds capable of reacting with or being adsorbed into silver halide. However, the above assumption should not be interpreted so as to restrict this invention or it relates to compounds capable of reacting with or being adsorbed into silver halide.

Preferred examples of compounds capable of reacting with or being absorbed into silver halide are nitrogen-containing heterocyclic compounds.

More than two types of these compounds can be used. These nitrogen-containing heterocyclic compounds are incorporated in an intensifying developing solution and/or a silver halide photographic material.

The preferred examples of nitrogen-containing heterocyclic compounds of this invention are 5-membered or 6-membered heterocyclic compounds containing a nitrogen atom, condensed ring thereof and nitrogen-containing heterocyclic compounds represented by the following general formulae (I) and (II).

General formula (I)

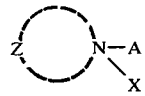

General formula (II)

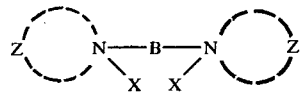

In the general formulae (I) and (II), A represents a substituted or unsubstituted alkyl group, alkenyl group, alkynyl group, aralkyl group, alicyclic hydrocarbon group or aryl group, B represents a substituted or unsubstituted di-valent hydrocarbon group. For example, the following di-valent groups are preferable.

$-(CH_2)_n-$, $-CH_2O-(CH_2)_n-O-CH_2-$,

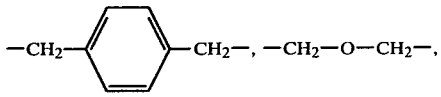

n represents an integer of 1 to 12. X represents an anion other than iodide. Z represents non-metallic group which forms a heterocyclic ring with a N atom.

The more preferred examples of 5-membered or 6-membered heterocyclic compounds containing a nitrogen atom and the condensed ring thereof are illustrated below.

General formula (III)

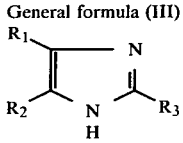

General formula (IV)

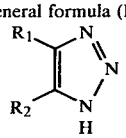

General formula (V)

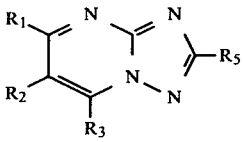

General formula (VI)

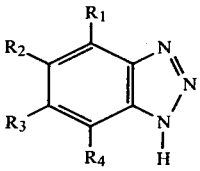

General formula (VII)

General formula (VIII)

-continued

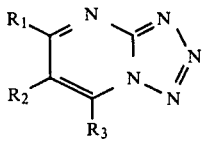

General formula (IX)

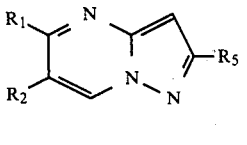

General formula (X)

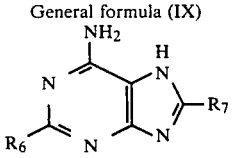

General formula (XI)

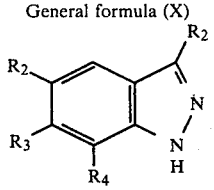

General formula (XII)

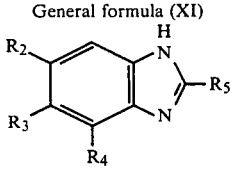

General formula (XIII)

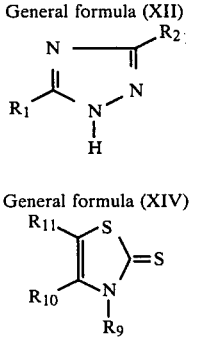

General formula (XIV)

In the general formulae (III) to (XIV), $R_1$, $R_2$, $R_3$ and $R_4$ each represents hydrogen, an alkyl group, an aralkyl group, an alkenyl group, an alkoxy group, an aryl group, —NRR′, —COOR, —$SO_3M$, —CONRR′, —$NHSO_2R$, —$SO_2NRR'$, —$NO_2$, an halogen atom, —CN or —OH group. (R and R′ each represents hydrogen, an alkyl group, an aryl group and an aralkyl group, M represents hydrogen, and an alkali metal atom.) When $R_1$ and $R_2$ each is an alkyl group, both may be connected with each other to form an aliphatic carbon ring.

$R_5$ represents hydrogen, an alkyl group having from 1 to 5 carbon atoms and —S—R″ group. (R″ is hydrogen, an alkyl group, an aryl group and an aralkyl group.) $R_6$ is hydrogen and an alkyl group.

$R_7$ is hydrogen, an alkyl group and an aryl group. $R_8$ represents an alkyl group, an aryl group, a benzyl group, a pyridyl group. $R_9$ represents an alkyl group, an alkenyl group, and an aryl group. $R_{10}$ and $R_{11}$ represent an alkyl group, an alkenyl group and an aryl group. When $R_{10}$ and $R_{11}$ are an alkyl group, both may be connected with each other to form an aromatic ring.

As a N-containing heterocyclic compound having a mercapto group, these compounds represented by the following general formula are preferable.

General formula (XV)

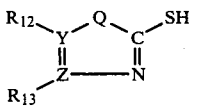

In the general formula (XV), Q represents an oxygen atom, a sulfur atom or an —NR‴ group (R‴ is hydrogen, an alkyl group, an unsaturated alkyl group, or a substituted or unsubstituted aryl or aralkyl group). Y and Z each is a carbon atom or a nitrogen atom, $R_{12}$ and $R_{13}$ each represents hydrogen, an alkyl group, an unsaturated alkyl group, a substituted or an unsubstituted aryl group, or a substituted or an unsubstituted aralkyl group, —SR⁗ and —$NH_2$ group (R⁗ is hydrogen, an alkyl group, an aryl group, an aralkyl group, an alkylcarboxylic acid or an alkali metal salt thereof, an alkylsulfonic acid or an alkali salt thereof), and when both of Y and Z are a carbon atom, $R_{12}$ and $R_{13}$ may form a substituted or unsubstituted aromatic ring.

The most preferred examples of the above-illustrated general formulae include the general formulae (IV), (VI), (X) and (XI).

Typical examples of the compounds of this invention are shown below.

(1)

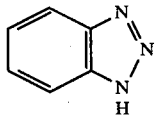

(2)

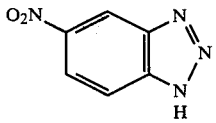

(3)

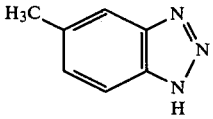

(4)

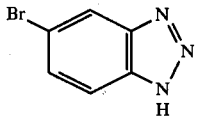

(5)

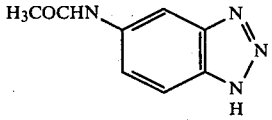

(6)

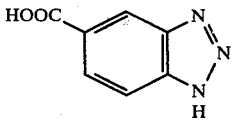

(7)

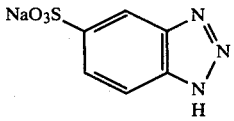

(8)

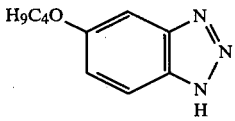

(9)

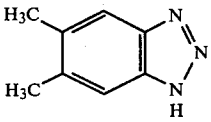

-continued
(10)
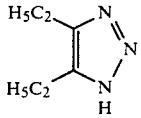
(11)
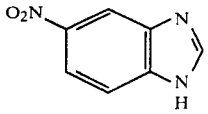
(12)
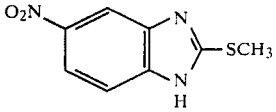
(13)
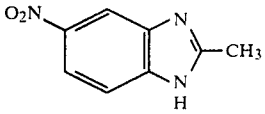
(14)
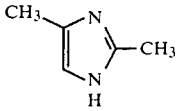
(15)
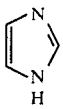
(16)
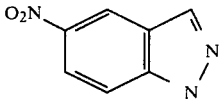
(17)
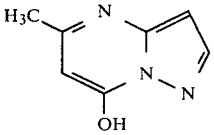
(18)
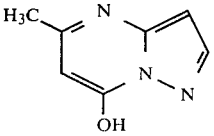
(19)
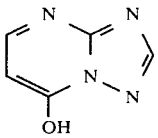
(20)
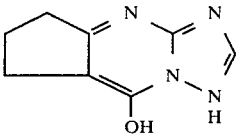
(21)
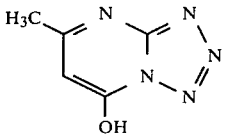
-continued
(22)
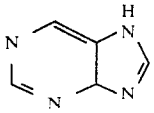
(23)
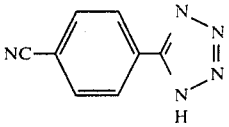
(24)
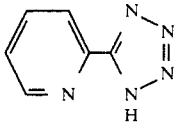
(25)
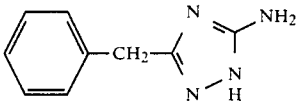
(26)
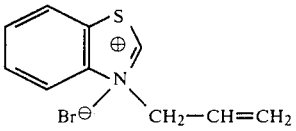
(27)
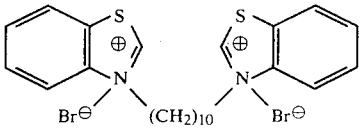
(28)
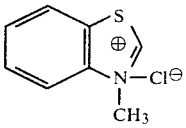
(29)
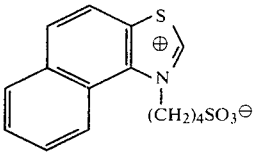
(30)
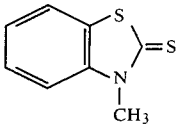
(31)
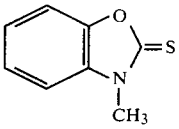

-continued
(32)
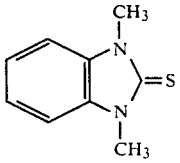
(33)
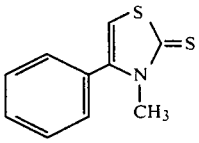
(34)
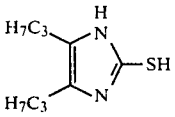
(35)
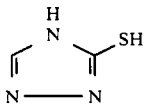
(36)
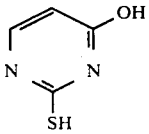
(37)
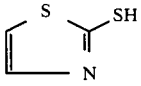
(38)
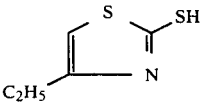
(39)
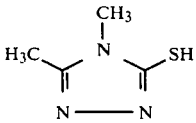
(40)
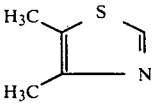
(41)
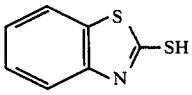
(42)
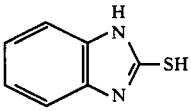
(43)
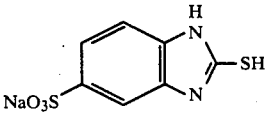
-continued
(44)
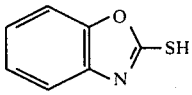
(45)
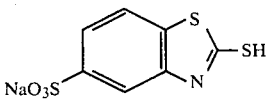
(46)
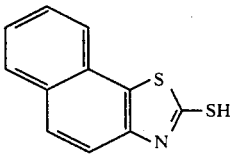
(47)
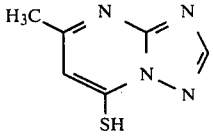
(48)
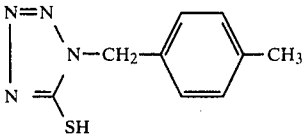
(49)
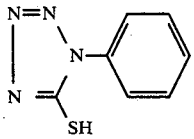
(50)
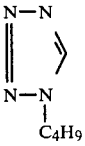
(51)
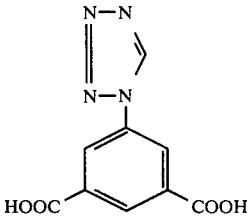
(52)
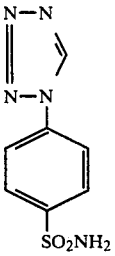

-continued (53)

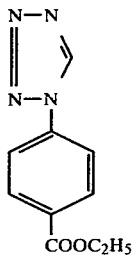

(54)

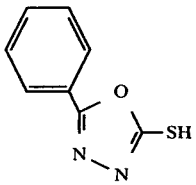

(55)

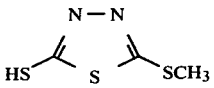

(56)

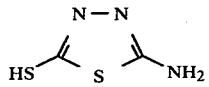

(57)

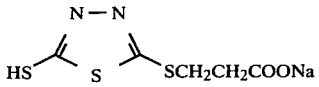

(58)

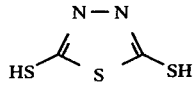

The amount of nitrogen-containing heterocyclic compounds having an anti-fogging effect to be added into the developing intensifier is not specifically limited. The amount depends on the kind of silver halide which is used in the silver containing-photographic materials, the amount of silver to be coated and the kind of compound having the above mentioned anti-fogging effect. However, it is preferred that the amount to be added is 1/10 or less than that conventionally employed in a developing solution and intensifying solution. The amount is generally between $1\times10^{-7}$ to $1\times10^{-2}$ mole per 1 liter of intensifying developing solution, preferably $1\times10^{-6}$ and $1\times10^{-3}$ mole/l, more particularly $3\times10^{-6}$ and $1\times10^{-4}$ mole/l. When these compounds are added to silver halide photographic materials, the amount thereof is generally $10^{-8}$ to $10^{-2}$ mole per $m^2$ of the photographic materials, preferably $10^{-7}$ to $10^{-3}$ mole/$m^2$. Further, nitrogen-containing heterocyclic compounds in the following prior arts can be used in this invention.

It is also possible to add nitrobenzimidazole as described in U.S. Pat. No. 2,496,940, British Pat. No. 403,789, U.S. Pat. Nos. 2,497,917 and 2,656,271, benztriazoles as described in "Nippon Shashin Gakkaishi", Vol. 11, page 48 (1948), quaternary heterocyclic salt such as benzthiazolium salt as described in U.S. Pat. Nos. 2,131,038, 2,694,716, and 3,326,681, tetrazaindenes as described in U.S. Pat. Nos. 2,444,605, 2,444,606, 2,444,607 and those of heterocyclic compounds as described in U.S. Pat. Nos. 2,173,628, 2,324,123 and 2,444,608 and those described in "Kagaku Shashin Binran" middle vol., page 119 (published by Maruzen in 1959).

Compounds which make up known developing solutions can be incorporated into the intensifying developing solution. For example, an inorganic phosphaoric acid and the salt thereof, a sodium hydroxide, a potassium hydroxide, a sodium carbonate, a potassium carbonate, a sodium hydrocarbonate, a potassium hydrocarbonate, a sodium quinolinate, a potassium quinolinate, a sodium metaborate, a potassium metaborate and borax are used as an alkali agent and a buffer agent. Particularly, it is preferred to use the inorganic phosphoric acid or the salt thereof, such as phosphoric acid, sodium dihydrogenphosphate, potassium dihydrogenphosphate, disodium hydrogenphosphate, dipotassium hydrogenphosphate, trisodium phosphate, tripotassium phosphate, sodium pyrophosphate, potassium pyrophosphate, pyrophosphoric acid, sodium hexametaphosphate, potassium hexametaphosphate, metaphosphoric acid, sodium tripolyphosphate or tetrapolyphosphate, alone or in combination with more than two, or in combination with another alkaline agent or a buffer agent. The amount of the inorganic phosphoric acid to be added or the salt thereof is more than $1\times10^{-3}$ mole/l, preferably more than $1\times10^{-2}$ mole/l.

In this invention, it is preferred to use as a stabilizing agent for the peroxide, at least one of those compounds as disclosed in "Hydrogen Peroxide" by Schumb et al., on pages 515–547 and in *Research Disclosure,* No. 11660, an organic phosphoric acid compounds and an ethylenediamine-tetra-acetatic acid and the salt thereof as disclosed in Japanese Patent Application (OPI) Nos. 10523/77 and 127555/80, an aminocarboxylic acid and the salt thereof such as nitrylotriacetate, cyclohexanediaminetetraacetate, imino-diacetate, hydroxyethylimino-diacetate, hydroxyethylethylenediamine triacetate, glycolethyldiaminetetraacetate, diethylenetriamine-pentaacetate, triethylenetetramine-6-acetate, diaminopropanol-tetraacetate or ethylenediamine-diorthohydroxyphenylacetate. The amount thereof is more than $1\times10^{-5}$ mole/l, preferably more than $1\times10^{-3}$ mole/l. The above-mentioned compounds are known as softeners for hard water and they are used in this invention in that respect. These facts are described in "Beligisches Chemiches Industry", Vol. 21, page 325 (1956), Vol. 23, page 1105 (1958) by J. W. Willems and in U.S. Pat. No. 4,083,723 incorporated herein by reference.

It is particularly preferred to use as compositions of the intensifying developing solution, these compounds and the aforementioned inorganic phosphoric acid or the salt thereof in combination. Although the reason is not clear, stability with the passage of time of the intensifying developing solution is increased by the combination thereof and the mono-bath intensifying developing solution having a reduced coloring or scum with the time passage can be obtained.

In this invention, the pH of the intensifying developing solution is generally in a range between 7 and 14, preferably between 8 and 13. A processing temperature is normally selected between 18° and 50° C., but those temperatures lower than 18° C. or higher than 50° C. are also acceptable.

A developing accelerator can be added to the developing accelerator can be added to the developing intensifying solution, if necessary. For example, various pyridium compounds and the other cationic compounds, cationic dyes such as phenosafranine, and neutral salts such as thallium nitrate or a potassium nitrate as represented by U.S. Pat. No. 2,648,604, Japanese Patent Publication No. 9503/69 and U.S. Pat. No. 3,671,247, polyethyleneglycols and derivatives thereof, a nonionic compound such as polythioethers as described in U.S. Pat. Nos. 2,533,990, 2,531,832, 2,950,970, 2,577,127 and Japanese Patent Publication No. 9504/69, organic solvents and organic amines as described in Japanese Patent publication No. 9509/69 and Belgian Pat. No. 682,862, the accelerating agent as described in L.F.A. Mason, "Photographic Processing Chemistry" pages 40–43 (Focal Press, London 1966), benzyl alcohol and phenylethyl alcohol as described in U.S. Pat. No. 2,515,147, pyridine, ammonia, hydrazine and amines as described in "Nippon Shashin Gakkaishi", Vol. 14, page 74 (1952) can be added.

There can also be added hydroxylamine sulfate and hydroxylamine hydrochloride, sodium sulfite, potassium sulfite, potassium bisulfite and sodium bisulfite.

Color developing agents used in this invention include p-phenylenediamine derivative color developing agents, onium salt type p-aminophenol derivative color developing agents as disclosed in U.S. Pat. No. 3,791,827, etc., dye developing agents as described in U.S. Pat. No. 2,983,606, diffusible dye releasing type (DDR) redox compounds as described in Japanese Patent Application (OPI) No. 33826/73, developing agents capable of reacting with an amidorazone compound, reducing agents that are oxidized to form a dye or the like (such as tetrazonium salt, 2,4-diaminophenol, α-nitroso-β-naphthol-leuco dyes) as disclosed in Japanese Patent Publication No. 39165/73 and the other reducing agents capable of forming a colored image after oxidation as disclosed in Japanese Patent Application (OPI) No. 6338/72 on pages 9 to 13. In these compounds, the reducing agents are the developing agents and to form a dye, some reducing agents are self-oxidized to couple with a color-coupler, some reducing agents are self-oxidized to form dyes, and the other reducing agents are previously colored and are oxidized to form non-diffusible dye.

Preferred examples of p-phenylenediamine derivative color developing agent include 2-amino-5-diethylaminotoluene hydrochloride, 2-amino-5-(N-ethyl-N-laurylamino)toluene, 4-[N-ethyl-N-(β-hydroxyethyl-)amino]aniline sulfate, 2-methyl-4-[N-ethyl-N-(β-hydroxyethyl)amino]aniline sulfate, N-ethyl-N-(β-metanesulfonamidoethyl)-3-methyl-4-amino-anilinesequisulfatemonohydrate as described in U.S. Pat. No. 2,193,015, N-(2-amino-5-diethylaminophenylethyl)methanesulfonamido sulfate and N,N-dimethyl-p-phenylenediamine hydrochlorinate as described in U.S. Pat. No. 2,592,364, 4-amino-3-methyl-N-ethyl-methoxyethylaniline, 4-amino-3-methyl-N-ethyl-N-ethyl-N-β-ethoxyethylaniline and 4-amino-3-methyl-N-ethyl-N-β-butoxyethylaniline and the salt thereof (such as sulfate, hydrochlorinate, sulfite, p-toluenesulfonate), as described in U.S. Pat. Nos. 3,656,950 and 3,698,525.

In addition to the above, those described in F. A. Mason "Photographic Processing Chemistry" (Focal Press, 1 1966), pages 226–229 can be used.

There are basically two types of reducing agents. In accordance with one type, the reducing agents themselves form dye images by oxidation. In accordance with the other type, the agents form complex salts with metallic salts. Examples of agents which belong to the latter type are the developing agents as shown in British Pat. No. 1,210,417, tetrazonium salt as shown in U.S. Pat. No. 3,655,382 and 2,4-diaminophenol and α-nitroso-β-naphthol. These reducing agents are oxidized by peroxides in the presence of a catalytic material, but are oxidized at an excessively low speed in the absence of a catalytic material. Those agents themselves are the image-forming elements and the oxidation products thereof are capable of forming images by reacting with color couplers.

Generally, photographic materials for camera use include silver salts containing silver in an amount of 3–10 g/m$^2$ and the materials for print use include silver salts containing silver in an amont of 1–4 g/m$^2$. The photographic materials of this invention include silver to be coated in an amount of less than 5 g/m$^2$ and preferably less than 3 g/m$^2$. In the multi-layer photograhic materials of this invention, each light-sensitive layer contains less than 1 g/m$^2$ of silver and particularly between 0.5 g/m$^2$ and 1 mg/m$^2$.

The color coupler used in this invention is the type of compound that it is reacted with the oxidized color developing agents to form dyes (i.e., a coupler).

Couplers used in this invention include dye-forming couplers as described hereinafter. More specifically, they include couplers capable of forming dyes by the oxidation coupling with an aromatic primary amine developing agent (such as phenylenediamine derivatives and aminophenol derivatives) in a color development. Specific examples of magenta couplers include 5-pyrazolone coupler, pyrazolobenzimidazole coupler, cyanoacetylcoumarone coupler, and openchained acylacetonitryle coupler. Examples of yellow couplers include acylamido couplers (for example, benzoylacetoanilides, pivalylacetoanides), and examples of cyan couplers include naphthol couplers and phenol couplers. Preferred couplers are non-diffusible ones having a hydrophobic group called a ballst group or polymerized couplers. Color couplers may be a 4-equivalent type or a 2-equivalent type with respect to silver ions. Colored couplers having the color adjusting effect or development inhibitor releasing couplers (DIR couplers) are also acceptable.

In addition, it is possible to use DIR couplers, and colorless DIR coupling compounds wherein the products of coupling reaction are colorless and the coupler releases developing inhibitors.

Specific examples of magenta color couplers are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, 4,241,168, German Pat. No. 1,810,464, German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, and in *Research Disclosure,* Vol. 179, No. 17938. Specific examples of yellow color couplers are disclosed in U.S. Pat. Nos. 2,875,057, 3,265,506, 3,408,194, 3,551,155, 3,582,322, 3,725,072, 3,891,445, German Pat. No. 1,547,868, German Patent Application (OLS) Nos. 2,219,917, 2,261,361, 2,414,006, British Patent 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77.

Specific examples of cyan color couplers are disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, German Patent Application (OLS) Nos. 2,414,830, 2,454,329, Japanese patent Application (OPI) Nos. 59838/73, 26034/76, 5055/73, 146828/76, 69624/77, and 90932/77.

Colored couplers are specifically disclosed in U.S. Pat. Nos. 3,476,560, 2,521,908, 3,034,892, Japanese Patent Publication Nos. 2016/69, 22335/63, 11304/67, 32461/69, Japanese Patent Application (OPI) Nos. 26034/76, 42121/77 and German Patent Application (OLS) No. 2,418,959.

Polymerized couplers which are used are specifically disclosed in U.S. Pat. Nos. 3,163,625 and 4,128,427 and in *Research Disclosure,* Vol. 188, No. 18815.

DIR couplers used are disclosed in U.S. Pat. Nos. 3,227,554, 3,617,291, 3,701,783, 3,790,384, 3,632,345, German Patent Application (OLS) Nos. 2,418,006, 2,454,301, 2,454,329, British Pat. No. 953,454, Japanese Patent Application (OPI) Nos. 69624/77, 122335/74, Japanese Patent Publication No. 16141/76.

In addition to DIR couplers, those compounds which release developing inhibitors during development may be incorporated in the photographic materials. Examples of such couplers are illustrated in U.S. Pat. Nos. 3,297,445, 3,379,529, German Patent Application (OPI) No. 2,417,914, Japanese Patent Application (OPI) Nos. 15271/77 and 9116/78.

Two types of the above-mentioned couplers can be incorporated into a layer, or one type of couplers can be incorporated into two or more layers in order to meet the required photographic properties.

A method of introducing couplers into silver halide photographic layers is disclosed, for example, in U.S. Pat. No. 2,322,027. For example, the couplers may be dissolved in an alkyl phthalate (e.g., dibutyl phthalate or dioctyl phthalate), phosphoric acid ester (e.g., diphenyl phosphate, triphenyl phosphate, tricresyl phosphate or dioctylbutyl phosphate), citric acid ester (e.g., tributylacetyl citrate), benzoic acid ester (e.g., octyl benzoate), alkylamino (e.g., diethyllaurylamido), fatty acid esters (e.g., dibuthoxyethyl succinate, diethyl azelate), trimesic acid esters (e.g., tributyl trimesate), organic solvents having a boiling point of from 30° to 150° C., e.g. lower alkyl acetate such as ethyl acetate or butyl acetate, ethyl propyonate, secondary butyl alcohol, methyl isobutyl ketone, $\beta$-ethoxyethyl acetate, methyl cellosolve acetate, and then be dispersed into a hydrophilic colloid. The above mentioned high boiling point solvents and low boiling solvents can be mixed together.

A dispersing method using polymers as disclosed in Japanese Patent Publication No. 39853/76 and Japanese Patent Application (OPI) No. 59943/76 can be also used in this invention.

When a coupler has acid groups such as carboxylic acid and sulfonic acid, they are introduced into a hydrophilic colloid in the form of an aqueous alkaline solution.

A photographic color coupler is preferably selected so as to give an intermediate scale image. It is preferred that the maximum absorption range of a cyan dye which is formed from a cyan coupler is between 600 and 720 nm, the maximum absorption range of a magenta dye which is formed from a magenta coupler is between 500 and 580 nm and the maximum absorption range of a yellow dye which is formed from a yellow coupler is between 400 and 480 nm.

A silver halide emulsion is usually prepared by mixing an aqueous solution of a water-soluble silver salt (e.g., silver nitrate) and an aqueous solution of a water-halogen salt (e.g., potassium bromide) in the presence of an aqueous solution of a water-soluble high molecular substance such as gelatin. Useful silver halide include not only a silver chloride and a silver bromide, but also a mixed silver halide such as silver chlorobromide, silver iodobromide or silver iodochlorobromide. The average particle size (when the particle is in the form of a ball or ball-like, the particle size means a diameter of a particle, and when the particle is in the form of cubic, the particle size means an edge of a particle, i.e., an average size of a projected area) is preferably lower than $2\mu$ and particularly preferable size is lower than $0.4\mu$. The distribution range of a particle size may be narrow or wide.

A shape of silver halide particles may be a cubic crystal, an octahedron or a mixture thereof.

More than two types of silver halide photographic emulsions prepared separately may be mixed. The crystal structure of a silver halide particle may be homogeneous inside and outside of the crystal, a layered structure being different between inside and outside of the crystal or a conversion type as disclosed in British Pat. No. 635,841 and U.S. Pat. No. 3,622,318. The latent image can be formed on the surface of the particle or in inside of the particle. These photographic emulsions are described and admitted in C. E. K. Mees, "The Theory of Photographic Process" published by MacMillan, P. Grafkides, "Chimie Photographique" published by Paul Montel (1957), and are prepared by the method as described in P. Glafkides, "Chimie et Physique Photographique" published by Montel (1967), G. F. Duffin, "Photographic Emulsion Chemistry" published by the Focal Press (1966) and V. L. Zelikman et al., "Making and Coating Photographic Emulsion" published by the Focal Press (1964). That is, it may be an acid method, a neutral method or an ammonium method. As a method for reacting a soluble silver salt with a soluble halogen salt, a single jet method, a double jet method and the mixture of these methods may be used. A method for forming silver halide particles in excess of a silver ion (a so-called reverse mixing method) can also be used. One type of useful double jet method is the so-called controlled double jet method wherein pAg in a liquid phase in which silver halide is formed is kept constant.

According to the method, a silver halide emulsion with a regular crystal form and nearly uniform crystal size can be obtained.

More than two types of silver halide emulsions prepared separately may be mixed together.

In a process of forming silver halide particles or physical ripening, a cadmium salt, a zinc salt, a lead salt, a talium salt, a iridium salt, a complex salt thereof, rhodium salt or a complex salt thereof, a ferric salt or a complex salt thereof may be co-present.

Soluble salts are usually removed from the emulsion after the precipitates are formed or physical ripening is completed. As a removal means, a known noodle washing method for gelation of gelatin, a precipitation reaction (flocculation method) utilizing inorganic salts containing polyvalent anions such as sodium sulfate, an anionic surfactant, an anionic polymer (e.g., polystylene sulfonate), or a gelatin derivative (e.g., an aliphatic acylated gelatin, an aromatic acylated gelatin or aromatic carbamoylated gelatin) can be also employed. The step of removing soluble salts can be omitted.

As a silver halide emulsion, a primitive emulsion which is prepared without conducting a chemical sensitization can be used, but the silver halide emulsion is generally chemically sensitized. Methods of chemical sensitization as described in prior arts by Glafkides or Zelikman or in H. Frieser, "Die Grundlagen der Photographischen Prozesse mit Silberhalogeniden" (Akademische Verlagsgesellschaft, 1968) can be applied.

More specifically, useful methods include a sulfur sensitization utilizing a sulfur-containing compound capable of reacting with a silver ion or an active gelatin, a reduction sensitization using a reducing compound, a noble metal sensitization using gold and other noble metal compounds can be used alone or in combination. Examples of sulfur sensitizing agents include thiosulfate, thioureidos, thiazoles, rhodanines and other compounds. Specific examples are described in U.S. Pat. Nos. 1,574,944, 2,410,689, 2,278,947, 2,728,668, 3,656,955, 4,032,928, 4,067,740. Examples of reducing sensitizing agents include stannous salts, amines, hydrazone derivatives, formamidine sulfinic acids and silane compounds. The specific examples are described in U.S. Pat. Nos. 2,487,850, 2,419,974, 2,518,698, 2,983,609, 2,983,610, 2,694,637, 3,930,867 and 4,054,458. Noble metal sensitization can be carried out with a gold complex salt, complex salts of metals belonging to VIII group of the periodic table such as platinum, iridium or palladium. Specific examples of such sensitizations are illustrated in U.S. Pat. Nos. 2,399,083 and 2,448,060, British Pat. No. 618,061.

In some cases, various additives are preferably incorporated into photographic materials to obtain desirable developing properties, image characteristics and physical properties of layers. Such additives include iodide compounds in the form of salts, organic compounds having a free mercapto radical (e.g., phenylmercaptotetrazole) and alkali metal iodides. It is preferred that these compounds are used in a small amount.

In order to increase sensitivity, contrast or to accelerate development, polyalkyleneoxide, ether, ester and amine thereof, thioether compounds, thiomorpholines, quaternary ammonium salt compounds, urethane derivatives, ureido derivatives, imidazole derivatives and 3-pyrazolidones can be incorporated in the photographic element. Specific examples thereof are described in U.S. Pat. Nos. 2,400,532, 2,423,549, 2,716,062, 3,617,280, 3,772,021, 3,808,003, British Pat. No. 1,488,991.

Preferred examples of an anti-foggants which are usually incorporated into a photographic silver halide emulsion layer and a light insensitive auxiliary layer, there are heterocyclic organic compounds such as tetrazoles, azaindenes, triazoles or aminopurine.

Other additives which can be incorporated into the photographic materials include a hardening agent, a plasticizer, a lubricant, a surface agent, a gloss agent and other additives known in the photographic fields.

The binder or a protective colloid is preferably gelatin but a hydrophilic colloid can also be used.

For example, proteins such as gelatin derivatives, a grafted polymer of gelatin and other polymers, albumin and casein; polysaccharides such as cellulose derivatives (e.g., hydroxyethylcellulose, carboxymethylcellulose or cellulose sulfate derivatives), sodium alginate, starch derivatives; various synthetic hydrophilic high molecular substances such as polyvinylalcohol, polyvinyl alcoholpartially-acetal, poly-N-vinylpyrazolidone, polyacrylic acid, polymethacrylic acid, polyacrylamido, polyvinylimidazole or polyvinylpyrazole can be used.

Examples of useful gelatins include lime-processed gelatin, acid-processed gelatin, enzyme-processed gelatin described in Bull. Soc. Sci. Phot. Japan, No. 16, page 30 (1966), and a hydrolysis product and enzyme-decomposed product of gelatin. Examples of useful gelatin derivatives include reaction products of gelatin with other various compounds such as an acid halide, an acid anhydride, isocyanates, a bromoacetate, an alkanesultones, vinylsulfoneamides, maleimides, polyalkyleneoxides or epoxy compounds. Specific examples are described in U.S. Pat. Nos. 2,614,928, 3,132,945, 3,186,846, 3,312,553, British Pat. Nos. 861,414, 1,033,189, 1,005,784, Japanese Patent Publication No. 26845/67.

Examples of the above-mentioned gelatin graft polymer include grafted gelatins with acrylic acid, methacrylic acid, ester derivatives thereof and amido derivatives thereof, vinyl monomer as homo- or copolymer such as acrylonitrile and styrene. Particularly preferable are those grafted polymers of gelatin wherein the polymer has marked compatibility with gelatin, such as acrylic acid, methacrylic acid, acrylamido, methacrylamido or hydroxyalkylmethacrylate. Examples are illustrated in U.S. Pat. Nos. 2,763,625, 2,831,767 and 2,956,884.

Typical examples of a synthetic hydrophilic high molecular substances are described in German patent Application (OLS) No. 2,312,708, U.S. Pat. Nos. 3,620,751, 3,879,205, and Japanese Patent Publication No. 7561/69.

A photographic emulsion can, if necessary, be spectrally sensitized by a cyanine dye such as a cyanine, merocyanine or a carbocyanine alone or in combination, or by the above cyanine dye with a styryl dye. The spectral sensitization has hitherto been known in the art as disclosed in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, German Patent Application (OLS) No. 2,030,326, 2,121,780, Japanese Patent Publication Nos. 4936/68, 14030/69, 10773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203. The dye for spectral sensitization can be selected optionally depending on the purpose and use of the photographic materials, for example, the wave length range to be sensitized, the sensitivity, etc.

A photographic material of this invention has at least one of silver halide emulsion layer on a support, and usually has a red-sensitive silver halide emulsion layer, a green-sensitive silver halide emulsion layer and a blue-sensitive silver halide emulsion layer on a support. In some cases, it has a red-sensitive silver halide emulsion layer containing a cyan image forming coupler, a green-sensitive silver halide emulsion layer containing a magenta image forming coupler and a blue-sensitive silver halide emulsion layer containing a yellow image forming coupler on a support.

A hydrophilic colloid layer of photographic materials may have a water soluble dye as a filter dye or for various purposes, for example, for preventing irradiation. Examples of the filter dyes include an oxonole dye, a hemioxonole dye, a styryle dye, a mercyanine dye, a cyanine dye and an azo dye. An oxonole dye, a hemioxonole dye and a mercyanine dye are particularly useful.

The photographic materials may contain a ultraviolet absorbing agent in a hydrophilic colloid layer. For example, benzotriazoles substituted with an aryl group, 4-thiazolidones, benzophenones, cinnamic esters, butadienens, benzooxazoles and ultraviolet ray absorbing polymers can be employed. These ultraviolet absorbing agents may be fixed in the hydrophilic colloid layer.

The photographic materials may contain a whitening agent such as stylbene, triazine, oxazoles or cumarine in a photographic emulsion layer or in other hydrophilic colloid layers. These compounds may be water-soluble or water-insoluble. When they are insoluble, they are used in the form of dispersion.

Examples of the fluorescent whitening agents are described in U.S. Pat. Nos. 2,632,701, 3,269,840, 3,359,102, British Pat. Nos. 852,075, 1,319,763, *Research Disclosure,* Vol. 176, No. 18743 (published in Dec. 1978), page 24, left column lines 9–36, "Brighteners".

The dyes and ultraviolet absorbing agents included in a hydrophilic colloid layer of photographic materials may be mordanted by cationic polymers. For example, those polymers as described in British Pat. No. 685,475, U.S. Pat. Nos. 2,675,316, 2,839,401, 2,882,156, 3,048,487, 3,184,309, 3,445,231, German Patent Application (OLS) No. 1,914,362, Japanese Patent Application (OPI) Nos. 47624/75, 71332/75, can be employed.

The light-sensitive material may contain as a color-anti-foggant, hydroquinone derivatives, aminophenol derivatives, gallic acid derivatives and ascorbic acid derivatives. The examples thereof are described in U.S. Pat. Nos. 2,360,290, 2,336,327, 2,403,721, 2,418,613, 2,675,314, 2,701,197, 2,704,713, 2,728,659, 2,732,300, 2,735,365, Japanese Patent Application (OPI) Nos. 92988/75, 92989/75, 93928/75, 110337/75, 146235/77, Japanese Patent Publication No. 23813/75.

In this invention, a known fade-preventing agent can be used. A color image stabilizing agent can be used alone or in combination. There are known fade-preventing agents such as hydroquinone derivatives, gallic acid derivatives, p-alkoxyphenols, p-oxyphenol derivatives or biphenols.

Specific examples of hydroquinone derivatives are disclosed in U.S. Pat. Nos. 2,360,290, 2,418,613, 2,675,314, 2,701,197, 2,704,713, 2,728,659, 2,732,300, 2,735,765, 2,710,801, 2,816,028, British Pat. No. 1,363,921. Examples of gallic acid derivatives are disclosed in U.S. Pat. Nos. 3,457,079 and 3,069,262. Examples of p-alkoxyphenols are disclosed in U.S. Pat. Nos. 2,735,765, 3,698,909, Japanese Patent Publication Nos. 20977/74 and 6623/77. Examples of p-oxyphenol derivatives are disclosed in U.S. Pat. Nos. 3,432,300, 3,573,050, 3,574,627, 3,764,337, Japanese Patent Application (OPI) Nos. 35633/77, 147434/77, and 152225/77 and those of bisphenols are described in U.S. Pat. Nos. 3,700,455.

A photographic emulsion layer and other hydrophilic colloid layers of this invention may contain a surfactant for various purposes, for example, as a coating aid or antistatic. The surfactant might also provide slippery-improvement, emulsification, adhesive protection and improve photographic properties (e.g., acceleration of development, and/or increase contrast and sensitization).

Examples of useful surface active agents include non-ionic surface active agents such as saponine (steroid type), alkylene oxide derivatives (e.g., polyethylene glycol, polyethylene glycol-polypropylene glycol condensate, polyethylene glycol alkyl ethers, polyethylene glycol alkyl aryl ethers, polyethylene glycol esters, polyethylene glycol sorbitan esters, polyalkylene glycol alkylamines, polyalkylene glycol alkylamides or polyethylene oxide adducts of silicone compounds), glycidol derivatives (e.g., alkenyl succinic acid polyglyceride or alkylphenol polyglyceride), fatty acid esters of polyhydric alcohols or alkyl esters of saccharide; anionic surface active agents having an acid group such as a carboxyl group, a sulfo group, a phospho group, a sulfuric ester group or a phosphoric ester group (e.g., alkyl carboxylate, alkyl sulfonate, alkyl benzene sulfonate, alkyl naphthalene sulfonate, alkyl sulfate, alkyl phosphate, N-acyl-N-alkyltaurate, sulfosuccinate, sulfoalkylpolyoxyethylene alkylphenyl ether or polyoxyethylene alkylphosphate); amphotric surface active agents such as amino acids, aminoalkyl sulfonates, aminoalkyl sulfates, aminoalkyl phosphates, alkyl betaines or amineoxides; and cationic surface active agents such as alkylamines, aliphatic or aromatic quaternary ammonium salts, heterocyclic quarternary ammonium salts (e.g., pyridinium or imidazolium), aliphatic or heterocyclic phosphonium salts or aliphatic or heterocyclic sulfonium salts.

A photographic emulsion layer and/or other hydrophilic colloid layers of photographic materials may include an inorganic or organic hardening agent. These agents may be used alone or in combination. Examples of these agents include chromium salts (chromium alum and chromium acetate), aldehydes (formaldehyde, glyoxal, glutaraldehyde), N-methylols (dimethylolurea, methyloldimethlhidantoin), dioxane derivatives (2,3-dihidroxydioxane), active vinyl compounds (1,3,5-triacryloylhexahydro-s-triazine, 1,3-vinylsulfonyl-2-propanol), active halogen compounds (2,4-dichloro-6-hydroxy-s-triazine), and mucohalogen acids (mucochlorinate, mucophenoxychloric acid).

A photographic material of this invention can contain water-insoluble or hardly water-soluble synthetic polymer dispersions which improve dimentional stability in a photographic emulsion layer and the other hydrophilic colloid layers. Examples of such include: alkyl(metha)acrylate, an alkoxyalkyl(metha)acrylate, glycidyl(metha)acrylate, (metha)acrylamide, vinylester (for example, vinylacetate), acrylonitryle, olefin and styrene. These materials can be used alone or in combination. Further, polymers comprising the combination of the above compounds with acrylic acid, methacrylic acid, $\alpha,\beta$-unsaturated dicarbonic acid, a hydroxyalkyl(metha)acrylate, a sulfoalkyl(metha)acrylate and styrenesulfonic acid as monomers can be used. Examples described in U.S. Pat. Nos. 2,376,005, 2,739,137, 2,853,457, 3,062,674, 3,411,911, 3,488,708, 3,525,620, 3,607,290, 3,635,715, 3,645,740, British Pat. Nos. 1,186,699 and 1,307,373 can be used.

A multi-layered color photographic material has at least one of a red-sensitive emulsion layer, a green-sensitive layer and a blue-sensitive emulsion layer, respectively. The order of the layers can be optionally determined. In general, a red-sensitive emulsion layer contains a cyan forming coupler, a green-sensitive emulsion layer contains a magenta forming coupler and a blue-sensitive emulsion layer contains a yellow forming coupler, respectively. In some cases, the combination of the layer and the coupler is different from the above.

A photographic material of this invention can comprise a material wherein an emulsion layer is composed of plural emulsion layer units, a material having various constructions, etc. as disclosed in U.S. Pat. No. 3,726,681, British Pat. Nos. 818,687, 923,045, U.S. Pat. No. 3,516,831, Japanese patent Application (OPI) Nos.

80225/76, 117631/76. Examples of photographic supports include cellulose nitrate film, cellulose acetate film, cellulose acetate butyrate film, cellulose acetate propionate film, polystyrene film, polyethylene terephthalate film, polycarbonate film and the laminated film thereof, thin glass, paper, etc., which are conventionally used for a photographic material. Baryta paper, a paper coated or laminated with a α-olefinpolymer and particularly a polymer of α-olefin having 2 to 10 carbon atoms such as polyethylene, polypropylene, ethylenebutane-copolymer, etc., or a plastic film the surface of which is made coarse to improve adhesive properties to photographic emulsion layer or hydrophilic colloid layer as described in Japanese Patent Publication No. 19068/72 can be preferably used.

These supports can be selected from transparent supports and opaque supports in accordance with the purpose of photographic materials. When the supports are transparent, they can be colorless or colored by incorporating dyes of pigments therein. This technic has been used in the production of X-ray photographic films and is also disclosed in "J. SMPTE", Vol. 67, page 296 (1958).

The opaque supports which are used in this invention include an opaque one such as paper, a plastic film containing a dye or pigment, e.g., titanium oxide, a plastic film with a surface treated by the method as disclosed in Japanese Patent Publication No. 19068/72, and a paper or plastic film which is completely shielded from light by incorporating carbon black or a dye therein. Further, a support can have a subbing layer to increase an adhesive property of photographic emulsion layer to the support. The surface of the support may be pretreated with a corona-discharging method, an ultraviolet ray exposure method or a flame treatment method to improve an adhesive property of photographic materials.

A photographic material of this invention comprises a support having coated hereon a dye image providing unit layer. A multi-color photographic material has at least two unit layers as disclosed above, each of which is exposed to light in a different spectral range. The unit layer contains a light-sensitive silver salt which is spectrally sensitized in a specific spectral range, and which is associated with a photographic color coupler. The dye image providing unit layers are effectively separated from each other by a separating layer, a spacing layer, a layer containing agent for removing oxidation products of developing agents, etc. The separation is maintained in order to prevent the unit layers from getting any color stain which is caused therebetween. Methods for effectively separating the unit layers are well known in the art and are applied to many commercial color photographic products to prevent them from getting color stain. A light-sensitive material having a layer for protecting against stain caused by development can be applied to this invention. Such layers are disclosed in U.S. Pat. No. 3,737,317, Japanese Patent Application (OPI) Nos. 23228/75 and 65230/75, etc.

A photographic layer used in the invention can be coated by a dip coating method, an air knife coating method, a curtain coating method or an extrusion coating method using a hopper coating device as disclosed in U.S. Pat. No. 2,681,294. Two or more photographic layers are simultaneously coated by methods as disclosed in U.S. Pat. Nos. 2,761,791, 3,508,947 and 837,095 if desired.

A color photographic materials of the invention can be prepared for the use of color image transfer methods as disclosed in U.S. Pat. Nos. 3,087,817, 3,185,567, 2,983,606, 3,253,915, 3,227,550, 3,227,551, 3,227,552, 3,145,633, 3,415,645 and 3,415,646, and for the use of absorption transfer methods as disclosed in U.S. Pat. No. 2,828,156. When a preformed dye type of color-former or a DRR type (Dye Releasing Redox compound type) of color-former is used in photographic materials of this invention, at least two dye image providing unit layers contain the couplers in at least 40% stoichiometric amount based on silver amount in the unit layers.

An intensifying developing solution used in the invention includes at least one developing agent (reducing agent) and, if necessary, some compounds which are known as component for developing solution.

In addition, the following additives can be incorporated in the intensifying developing solution: a competing coupler, e.g., citrazinic acid, J acid, J acid, etc. as disclosed in Japanese Patent Publication Nos. 9505/69, 9506/69, 9507/69, 14036/70 and 508/69, U.S. Pat. Nos. 2,742,832, 3,520,690, 3,560,212 and 3,645,737; a fogging agent, e.g., alkali metal borohydride, amineborane, ethylenediamine, etc., as disclosed in Japanese Patent Publication No. 38816/72; a compensating developing agent, e.g., p-aminophenol, benzyl-p-aminophenol, 1-phenyl-3-pyrazolidone, etc. as disclosed in Japanese Patent Publication Nos. 41475/70, 19037/71 and 19438/71. The amount of the compensating developing agent is preferably 0.001 to 0.5 g/liter.

According to a typical process of the invention, color images are formed by imagewise exposing a silver halide color photographic material, intensifying developing the imagewise exposed photographic material, fixing or bleach-fixing it, washing and drying it. Alternatively, a stabilizing or rinsing step after the intensifying developing step can be conducted instead of the fixing or bleach-fixing step and the washing step.

In another embodiment of this invention, a coupler can be incorporated in an intensifying developing solution. The coupler is known as a coupler of the developer type which is diffusible and is used in a developing solution: for example, a cyan coupler as disclosed in U.S. Pat. Nos. 3,002,836 and 3,542,552; a magenta coupler as disclosed in Japanese Patent Publication No. 13111/69; a yellow coupler as disclosed in U.S. Pat. No. 3,510,306. In this case, the concentration of the coupler in the developer is 0.5 to 5 g/l, preferably 1 to 25 g/l.

In still another embodiment of this invention, an intensifying developing solution is applied to superimposed areas between a light-sensitive layer and an image-receiving layer, whereby development and intensification are simultaneously carried out. The dye which is oxidized by hydrogen peroxide or a compound capable of releasing hydrogen peroxide to be movable is transferred to the image-receiving layer. Alternatively, a movable dye can be transferred from an unoxidized area.

An imagewise exposure for obtaining photographic images can be conducted in a conventional manner. That is, various well-known light sources, e.g., natural light (sun light), tungsten light, fluorescent light, mercury light, xenon arc light, carbon arc light, xenon flash light or cathode ray tube flying spot can be used. An exposure time is 1/1000 to 1 second for in camera, shorter than 1/1000 second (e.g., $1/10^4$ to $1/10^6$ second for xenon arc light or cathode ray tube), or longer than 1 second. If necessary, spectral composition of exposure light can be controlled by employing a color filter. A laser light may be used for exposure. Further, image-wise exposure can be conducted by light released from a fluorescent substance which is excited by an electron beam, X-ray, γ-ray or α-ray.

EXAMPLE 1

To the paper support both surfaces of which were laminated with polyethylene dispersed with titanium dioxide were coated the following first and the second layers to prepare photographic elements.

| | |
|---|---|
| Second layer | gelatin (1000 mg/m$^2$) |
| First layer | silver chlorobromide emulsion (silver bromide 30 mole %, silver 5 mg/m$^2$, average particle size 0.2μ) |
| | gelatin (1000 mg/m$^2$) |
| | coupler dispersed in phosphoric acid-o-cresylester: 1-(2,4,6-trichlorophenyl)-3-[2-chloro-5-tetradecanadmido]anilino-2-pyrazolin-5-on (300 mg/m$^2$) |
| | Support |

The above sample was exposed by a sensitometer and processed with the following steps.

| | Temperature | Time |
|---|---|---|
| Processing step 1 | | |
| Color development | 35° C. | 2 min. |
| Fixation | 25–40° C. | 1 min. |
| Water washing | 25–40° C. | 5 min. |
| Processing step 2 | | |
| Mono-bath developing intensifying | 35° C. | 1 min. |
| Fixation | 25–40° C. | 1 min. |
| Processing step 3 | | |
| Mono-bath developing intensifying | 25° C. | 2 min. |
| Fixation | 25–40° C. | 1 min. |
| Water washing | 25–40° C. | 5 min. |

| Color developing solution | |
|---|---|
| Benzylalcohol | 15 ml |
| Diethyleneglycol | 8 ml |
| Ethylene diamine tetraacetic acid | 5 g |
| Sodium sulfite | 2 g |
| Carbonic anhydride | 30 g |
| Hydroxyamine sulfate | 3 g |
| Potassium bromide | 0.6 g |
| 4-amino-3-methyl-N—ethyl-N—β-(methanesulfonamido)ethylaniline 3/2 sulfonate. monohydrate | 5 g |
| Water to make | 1000 ml |
| | pH 10.1 |

| Developing intensifying solution | |
|---|---|
| Potassium sulfite | 4 g |
| Potassium phosphate | 40 g |
| Dipotassium hydrogenphosphate | 6 g |
| 1-Hydroxyethane-1,1-diphosphoric acid | 2 g |
| 5-Nitrobenzotriazole | 10 mg |
| 4-Amino-3-methyl-N—ethyl-N—β-(methanesulfoneamido)ethylaniline 3/2 sulfonate. monohydrate | 4 g |
| Hydrogen peroxide (30%) | 20 ml |
| Water to make | 1 l |
| | pH 11.0 |

| Fixing solution | |
|---|---|
| Ammonium thiosulfate | 150 g |
| Sodium sulfite | 10 g |
| Sodium hydrogensulfite | 2.5 g |
| Water to make | 1 l |

The magenta density of the sample treated in processing steps 1, 2 and 3 was measured and the results are shown in Table 1.

The amount of silver in the sample was extremely small, and hardly contributed to image density. Therefore, the bleaching step was omitted.

TABLE 1

| Processing step | Fog | Maximum density |
|---|---|---|
| 1 | 0.08 | 0.20 |
| 2 | 0.10 | 2.52 |
| 3 | 0.10 | 2.50 |

When the sample was color-developed in a conventional way (processing step 1), the resulting density was very low, since the amount of silver in the sample was substantially lowered. When the sample was treated in a mono-bath developing intensifying solution using hydrogen peroxide of this invention (processing steps 2 and 3), fog was completely inhibited and images with high maximum density were obtained in a short treating period (in processing step 2: 35° C., 1 min.).

EXAMPLE 2

To the paper support both surfaces of which were laminated with polyethylene dispersed with titanium dioxide were coated the following first (innermost layer)-sixth layer (uppermost layer) to prepare photographic color materials with a smll amount of silver (in the following Table below, mg/m$^2$ represents the amount to be coated).

| | |
|---|---|
| Sixth layer | gelatin (1000 mg/m$^2$) |
| Fifth layer (red-sensitive layer) | silver chlorobromide emulsion (silver bromide 30 mole %, silver 5 mg/m$^2$, average particle size 0.2μ) |
| | gelatin (1000 mg/m$^2$) |
| | cyan coupler (*1) (400 mg/m$^2$) |
| | coupler solvent (*2) (200 mg/m$^2$) |
| Fourth layer | gelatin (1200 mg/m$^2$) |
| | ultraviolet ray absorbing agent (*3) (1000 mg/m$^2$) |
| | dioctylhydroquinone (50 mg/m$^2$) |
| Third layer (green-sensitive layer) | silver chlorobromide (AgBrCl) (silver bromide 30 mole %, silver 5 mg/m$^2$, average particle size 0.2μ) |
| | gelatin (1000 mg/m$^2$) |
| | magenta coupler (*4) (300 mg/m$^2$) |
| | coupler solvent (*5) (300 mg/m$^2$) |
| Second layer | gelatin (1000 mg/m$^2$) |
| Fisrt layer (blue-sensitive layer) | silver chlorobromide emulsion (AgBrCl) (silver bromide 80 mole %, silver 8 mg/m$^2$, average particle size 0.4μ) |
| | gelatin (1200 mg/m$^2$) |
| | yellow coupler (*6) (300 mg/m$^2$) |
| | coupler solvent (*2) (150 mg/m$^2$) |
| | Support |

(*1) Cyan coupler: 2-[α-(2,4-di-t-aminophenoxy)buthane-amido]-4,6-dichloro-5-methylphenol
(*2) Coupler solvent: n-butyl phthalate
(*3) Ultraviolet ray absorbing agent: 2-(2-hydroxy-3-sec-butyl-5-t-buthylphenyl)benzotriazole
(*4) Magenta coupler: 1-(2,4,6-trichlorophenyl)-3-[2-chloro-5-tetradecanamido]anilino-2-pyrazoline-5-on
(*5) Coupler solvent: o-cresyl phosphate
(*6) Yellow coupler: α-pivaloyl-α-[2,4-dioxo-5,5'-dimethyloxazolidine-3-yl]-2-chloro-5-[α-(2,4-di-t-amilphenoxy)buthaneamido]acetoanilido The sample was exposed by the sensitometer and processed as follows.

| | Temperature | Time |
|---|---|---|
| Processing step - [I] | | |
| Color development | 40° C. | 1 min. |
| Intensification | 40° C. | 2 min. |
| Water washing | 25–40° C. | 1 min. |

TABLE 2

| No. | Processing Step | Processing Solution | Fog R | Fog G | Fog B | Maximum Density R | Maximum Density G | Maximum Density B | Relative* Sensitivity R | Relative* Sensitivity G | Relative* Sensitivity B |
|---|---|---|---|---|---|---|---|---|---|---|---|
| 1 | [I] | Intensifying solution (I) | 0.28 | 0.26 | 0.26 | 1.14 | 1.10 | 1.02 | 75 | 73 | 70 |
| 2 | " | Intensifying solution (II) | 0.24 | 0.22 | 0.23 | 1.12 | 1.08 | 1.02 | 75 | 71 | 70 |
| 3 | " | Intensifying solution (III) | 0.12 | 0.12 | 0.10 | 0.60 | 0.55 | 0.50 | 43 | 40 | 45 |
| 4 | [II] | Developing intensifying solution (IV) | 0.20 | 0.22 | 0.26 | 2.60 | 2.55 | 2.48 | 100 | 100 | 100 |
| 5 | " | Developing intensifying solution (V) | 0.11 | 0.10 | 0.12 | 2.55 | 2.52 | 2.48 | 96 | 100 | 105 |

*Relative values in case when the sensitivity of the sample processed by the processing step (II) (No. 4) is made 100.

-continued

| | | | |
|---|---|---|---|
| Bleach-fix | 40° C. | | 1 min. |
| Water washing | 25-40° C. | | 1.5 min. |
| Processing step - [II] | | | |
| Mono-bath developing intensification | 40° C. | | 1 Min. |
| Water washing | 25-40° C. | | 1 min. |
| Bleach-fix | 40° C. | | 1 min. |
| Water washing | 25-40° C. | | 1.5 min. |
| Color developing solution | | | |
| Benzylalcohol | | | 15 ml |
| Potassium sulfite | | | 4 g |
| Potassium bromide | | | 0.5 g |
| Potassium carbonate | | | 30 g |
| Hydroxylamine sulfate | | | 3 g |
| Diethylenetriamine pentaacetate | | | 5 g |
| 4-Amino-3-methyl-N—ethyl-N—β-(methanesulfonamido)ethylaniline 3/2 sulfate.monohydrate | | | 6 g |
| Potassium hydroxide | | | 1.2 g |
| Water to make | | | 1 l |
| | pH | | 10.1 |
| Bleach-fixing solution | | | |
| Ethylenediamine tetraacetate | | | 2 g |
| Ethylenediamine tetraacetate ferric salt | | | 40 g |
| Sodium sulfite | | | 5 g |
| Ammonium thiosulfate | | | 70 g |
| Water to make | | | 1 l |
| Intensifying solution | (I) | (II) | (III) |
| Hydrogen peroxide (30%) | 30 ml | 30 mg | 30 ml |
| Sodium carbonate (monohydrate) | 20 g | 20 g | 20 g |
| Benzotriazole | 0 | 5 mg | 100 mg |
| 1-Hydroxyethylidene-1,1-diphosphonic acid | 4 g | 4 g | 4 g |
| Water to make | | | 1 l |
| | | pH | 10.0 |
| Developing intensifying solution | | (IV) | (V) |
| [A] Potassium sulfite | | 4 g | 4 g |
| Sodium carbonate (monohydrate) | | 15 g | 15 g |
| Ethylene diamine tetraacetate | | 2 g | 2 mg |
| Benzotriazole | | 0 | 5 mg |
| 4-Amino-3-methyl-N—ethyl-N—β-(methanesulfonamido)ethylaniline 3/2 sulfate.monohydrate | | 4 g | 4 g |
| Water to make | | | 1 l |
| | | pH | 10.0 |
| [B] Hydrogen peroxide (30%) | | 20 ml | 20 ml |

The mixed solutions of [A] and [B] are named as the developing intensifying solution.

Cyan, magenta and yellow densities of the sample processed in the processing steps [I] and [II] were measured and the results thereof were shown in Table 2.

No. 1 to No. 3 are comparative examples wherein processing steps were different from those of this invention. No. 4 is a comparative example of the developing intensifying solution and No. 5 is an example of the intensifying solution of this invention.

With respect to characteristic values, it should be noted that both of the maximum density and the relative sensitivity of the sample processed by a mono-bath type developing intensifying step (II) are higher than those processed by a developing-intensifying step (I). In the processing step (I), when an anti-foggant is incorporated to completely inhibit fogs, the maximum density and the relative sensitivity are remarkably lowered. On the other hand, in processing step (II) (No. 5) of this invention, fogs are sufficiently prevented without lowering the maximum density and the relative sensitivity. This is because that the amount of the anti-foggant used in the mono-bath type intensifying solution is smaller by one order than that used in the intensifying solution. It is also clear that even in the photographic material with a greatly lower silver content, sufficiently high image density can be obtained by the process of a mono-bath type developing intensifying solution of the present invention.

EXAMPLE 3

The same as used in Example 2 was exposed by a sensitometer and processed as follows.

| | Temperature | Time |
|---|---|---|
| Processing step | 35° C. | 1 min. |
| intensification | | |
| Water washing | 25-40° C. | 5 min. |
| Developing intensifying solution | | |
| Potassium sulfite | | 4 g |
| Tripotassium phosphate | | 40 g |
| Potassium dihydrogenphosphate | | 6 g |
| Ethylenediamine pentaacetate | | 2 g |
| 4-Amino-3-methyl-N—methyl-N—β-(methanesulfonamido)ethylaniline 3/2 sulfate. monohydrate | | 4 g |
| Hydrogen peroxide (30%) | | 20 ml |
| Water to make | | 1 l |
| | | pH 11.0 |

To the above-mentioned developing intensifying solution, five different additives were included to prepare the following seven developing intensifying solutions.

| No. | Anti-Foggant | Additive Amount |
|---|---|---|
| Comparative Example 1 | None | — |
| 2 | Potassium bromide | $2 \times 10^{-5}$ mole |
| 3 | Potassium bromide | $1 \times 10^{-4}$ mole |
| Invention 4 | Benzotriazole (compound-1) | $3 \times 10^{-5}$ mole |

-continued

| No. | Anti-Foggant | Additive Amount |
|---|---|---|
| 5 | 5-Nitrobenzotriazole (compound-2) | $6 \times 10^{-5}$ mole |
| 6 | 5-nitrobenzoimidazole (compound-11) | $3 \times 10^{-5}$ mole |
| 7 | 1-phenyl-5-mercaptotetrazole (compound-49) | $3 \times 10^{-5}$ mole |

Nos. 1–3 are comparative examples of the developing intensifying solutions and Nos. 4–7 are the developing intensifying solution of this invention.

The results obtained after testing the photographic characteristic values using solutions 1–7 are shown in Table 3.

The amount of silver to be coated of the sample employed in this example is vary small and the developed silver and the print-out silver photodecomposed under the sun exposure hardly contribute to the image density. Therefore, a fixing process or a bleach-fixing process was omitted and water-washing was proceeded subsequently.

TABLE 3

| | Fog | | | Maximum Density | | | Relative* Sensitivity | | |
|---|---|---|---|---|---|---|---|---|---|
| No. | R | G | B | R | G | B | R | G | B |
| 1 | 0.18 | 0.22 | 0.64 | 2.58 | 2.54 | 2.50 | 100 | 100 | 100 |
| 2 | 0.14 | 0.20 | 0.54 | 2.12 | 2.14 | 2.25 | 83 | 91 | 100 |
| 3 | 0.14 | 0.16 | 0.38 | 1.64 | 1.76 | 1.78 | 75 | 78 | 90 |
| 4 | 0.11 | 0.12 | 0.13 | 2.55 | 2.53 | 2.49 | 98 | 104 | 118 |
| 5 | 0.12 | 0.12 | 0.14 | 2.56 | 2.53 | 2.48 | 99 | 106 | 120 |
| 6 | 0.11 | 0.12 | 0.13 | 2.56 | 2.54 | 2.50 | 94 | 98 | 108 |
| 7 | 0.12 | 0.14 | 0.16 | 2.38 | 2.36 | 2.32 | 100 | 102 | 115 |

*Relative values when the sensitivity of the sample processed in No. 1 was made 100.

When potassium bromide, as an anti-foggant, is commonly incorporated in a developing solution (No. 1 and No. 2), not only are the maximum density and the relative sensitivity reduced, but fog can not be completely inhibited. Therefore, bromide ion should not be added. However, when the nitrogen containing heterocyclic compound (Nos. 4, 5, 6 and 7) is used in a ratio of between $10^{-5}$ and $10^{-4}$ mole/l (the ratio changes depending upon the type of compounds used), images with a high density in which fog is sufficiently inhibited are obtained. Further, as the amount of silver to be coated on the sample because extremely small, the step of removing silver such as bleaching or bleach-fixing can be omitted. Therefore, the processing steps are reduced and a simple method is accomplished.

EXAMPLE 4

First and second layers were coated on a cellulose triacetate film support to prepare a photographic material.

| | |
|---|---|
| The second layer | gelatin (1000 mg/m$^2$) |
| The first layer | silver chlorobromide emulsion (silver bromide 70 mole %, silver 20 mg/m$^2$, average particle size 0.4$\mu$) |
| | gelatin (1000 mg/m$^2$) |
| | coupler dispersed in n-butyl phthalate: 2-[$\alpha$-(2,4-di-t-amylphenoxy)butaneamido]-4,6-dichloro-5-methylphenol (1000 mg/m$^2$) |
| | Support |

To the above sample was added additives to prepare five samples as described below. These samples were exposed by a sensitometer and were processed by the following processes.

| Processing step | Temperature | Time |
|---|---|---|
| Mono-bath type developing intensifying | 35° C. | 1 min. |
| Fixation | 25–40° C. | 1 min. |
| Water-washing | 25–40° C. | 5 min. |
| Developing intensifying solution | | |
| Potassium sulfite | | 4 g |
| Tripotassium phosphate | | 40 g |
| Dipotassium hydrogenphosphate | | 6 g |
| 1-Hydroxyethane-1,1-disulfonate | | 2 g |
| 4-Amino-3-methyl-N—ethyl-N—$\beta$-(methanesulfonamido)ethyaniline 3/2 sulfate.monohydrate | | 4 g |
| Hydrogen peroxide (30%) | | 20 ml |
| Water to make | | 1 l |

The fixing solution was the same as that used in Example 1.

| No. | Anti-Foggant | Amounts to be Added per m$^2$ |
|---|---|---|
| 1 | none | — |
| 2 | 5-methylbenzotriazole (compound-3) | $0.93 \times 10^{-5}$ mole |
| 3 | 5-nitrobenzoimidazole (compound-11) | $1.85 \times 10^{-5}$ mole |
| 4 | 5-nitrobenzindazole (compound-16) | $1.85 \times 10^{-5}$ mole |
| 5 | 1-phenyl-5-mercapto tetrazole (compound-49) | $3.70 \times 10^{-7}$ mole |

Cyan density of the sample thus processed was measured and the results are shown in Table 4.

TABLE 4

| No. | Fog | Maximum density | Relative Sensitivity* |
|---|---|---|---|
| 1 | 0.53 | 3.54 | 100 |
| 2 | 0.05 | 3.35 | 85 |
| 3 | 0.14 | 3.20 | 89 |
| 4 | 0.10 | 3.11 | 103 |
| 5 | 0.06 | 3.54 | 93 |

*Relative values when the sensitivity of the sample of No. 1 was made 100.

Nitrogen-containing heterocyclic compounds No. 2 to No. 5 were added into a silver halide photograhic material in a ratio of $10^{-5}$ to $10^{-6}$ mole/m$^2$. However, the amount to be added varies depending upon the type of compounds. By adjusting the amount of compound added fogs caused by developing intensifying can be sufficiently inhibited. Excellent photographic images can also be obtained without substantially lowering the maximum density or the relative sensitivity. Accordingly, the objects of the present invention can also be achieved if an anti-foggant comprised of nitrogen-containing heterocyclic compounds is incorporated into the photographic material.

While the invention has been described in detail and with reference to specific embodiment thereof, it will be apparent to one skilled in the art that various changes and modifications can be made therein without departing from the spirit and scope thereof.

What is claimed is:

1. An image-forming method, comprising the steps of:

providing a silver halide color photographic material;

imagewise exposing the material; and color-developing the exposed material in the presence of a nitrogen-containing heterocyclic compound having the general formula (I) or (II):

General formula (I)

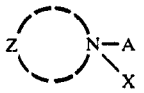

General formula (II)

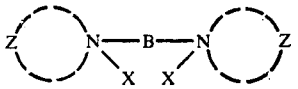

wherein A is an alkyl group, an alkenyl group, an alkynyl group, an aralkyl group, an alicyclic hydrocarbon group, or an aryl group, each of which may be substituted, B is a substituted or unsubstituted di-valent hydrocarbon group, X is an anion other than iodide and Z is a non-metallic group which forms a heterocyclic ring with a nitrogen atom, wherein said compound is capable of reacting with or being adsorbed into a silver halide, with a mono-bath intensifying developing solution which includes hydrogen peroxide or a compound capable of releasing hydrogen peroxide and a color developing agent, the solution substantially excluding the presence of bromide ions and iodide ions.

2. An image-forming method, as claimed in claim 1, wherein the developing solution contains the color-developing agent in an amount of at least $10^{-3}$ mol/l of developing solution.

3. An image-forming method, as claimed in claim 2, wherein the color-developing agent is present in an amount of $2\times10^{-3}$ to $10^{-1}$ mol/l of solution.

4. An image-forming method, as claimed in claim 1, wherein hydrogen peroxide is present within the solution in an amount of from 0.5 to 200 mol per mol of the color-developing agent.

5. An image-forming method, as claimed in claim 4, wherein the hydrogen peroxide is present in an amount of 1 to 80 mol per mol of the color-developing agent.

6. An image-forming method as claimed in claim 1, wherein bromide ions and iodide ions are present in an amount of $2\times10^{-4}$ mol/l of solution or less.

7. An image-forming method as claimed in claim 6, wherein all bromide ions and iodide ions are excluded from the solution.

8. An image-forming method, as claimed in claim 1, wherein the di-valent group is selected from the groups consisting of:

$-(CH_2)_n-$, $-CH_2O(CH_2)_nO-CH_2-$,

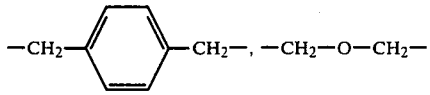

wherein n is an integer of from 1 to 12.

9. An image-forming method as claimed in claim 1, wherein the nitrogen-containing heterocyclic compound is a compound represented by the general formula (III) to (XIV) as follows:

General formula (III)

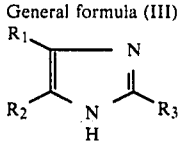

General formula (IV)

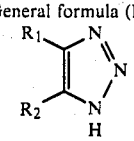

General formula (V)

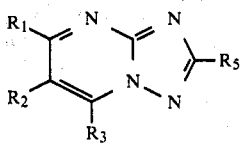

General formula (VI)

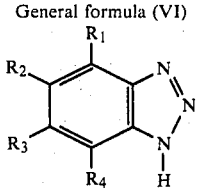

General formula (VII)

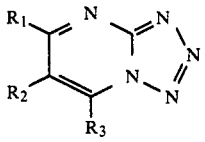

General formula (VIII)

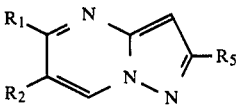

General formula (IX)

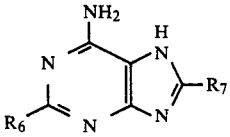

General formula (X)

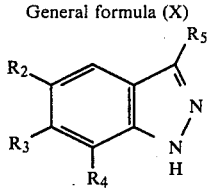

General formula (XI)

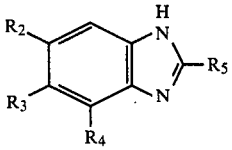

General formula (XII)

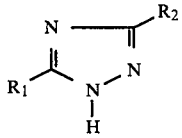

General formula (XIII)

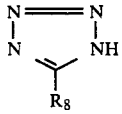

General formula (XIV)

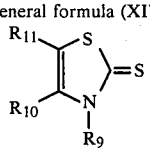

General formula (XV)

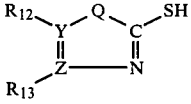

wherein $R_1$, $R_2$, $R_3$ and $R_4$ each represents hydrogen, an alkyl group, an aralkyl group, an alkynyl group, an alkoxy group, an aryl group, —NRR'—, —COOR, —$SO_3M$, —CONRR', —$NHSO_2R$, —$SO_2NRR'$—, —$NO_2$, a halogen atom, —CN or —OH group, wherein R and R' are each hydrogen, an alkyl group, an aryl group and an aralkyl group, M is hydrogen and an alkyl metal atom; $R_5$ represents hydrogen, an alkyl group having from 1 to 5 carbon atoms and —S—R'' group, wherein R'' is hydrogen, an alkyl group, an aryl group and an aralkyl group; $R_6$ is hydrogen and an alkyl group; $R_7$ is hydrogen, an alkyl group and an aryl group; $R_8$ represents an alkyl group, an aryl group, a benzyl group, a pyridyl group; $R_9$ represents an alkyl group, an alkenyl group, and an aryl group; $R_{10}$ and $R_{11}$ represent an alkyl group, an alkenyl group and an aryl group; Q represents an oxygen atom, a sulfur atom or an —NR″ group wherein R″ is hydrogen, an alkyl group, an unsaturated alkyl group, or a substituted or unsubstituted aryl or aralkyl group; Y and Z each is a carbon atom or a nitrogen atom; and $R_{12}$ and $R_{13}$ each represents hydrogen, an alkyl group, an unsaturated alkyl group, a substituted or an unsubstituted aryl group, or a substituted or an unsubstituted aralkyl group, —SR″″ and —$NH_2$ group, wherein R″″ is hydrogen, an alkyl group, an aryl group, an aralkyl group, an alkylcarboxylic acid or an alkali metal salt thereof, an alkylsulfonic acid or an alkali metal salt thereof.

10. An image-forming method, as claimed in claim 9, wherein the nitrogen-containing heterocyclic compound is present in an amount of from $1\times10^{-7}$ to $1\times10^{-2}$ mol/l of intensifying developing solution.

11. An image-forming methods as claimed in claim 10, wherein the nitrogen-containing heterocyclic compound is present in an amount of $1\times10^{-6}$ to $1\times10^{-3}$ mol/l of intensifying developing solution.

12. An image-forming method as claimed in claim 11, wherein the nitrogen-containing heterocyclic compound is present in an amount of $3\times10^{-6}$ to $1\times10^{-4}$ mol/l of intensifying developing solution.

13. An image-forming method as claimed in claim 12, wherein the intensifying developing solution has a pH of from 7 to 14.

14. An image-forming method as claimed in claim 13, wherein the intensifying developing solution has a pH of from 8 to 13.

* * * * *

UNITED STATES PATENT AND TRADEMARK OFFICE

CERTIFICATE OF CORRECTION

PATENT NO. : 4,414,305

DATED : November 8, 1983

INVENTOR(S) : Koichi Nakamura; Hiroyuki Hirai

It is certified that error appears in the above-identified patent and that said Letters Patent is hereby corrected as shown below:

Column 29, line 10, delete "or" and insert --,--; same line after "(II)", insert --, (III), (IV), (V), (VI), (VII), (VIII), (IX), (X), (XI), (XII), (XIII), (XIV), or (XV)--.

Column 29, after line 20, insert the following

--

General formula (III)

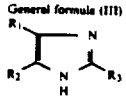

General formula (IV)

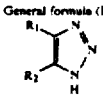

General formula (V)

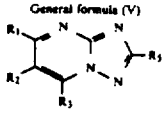

General formula (VI)

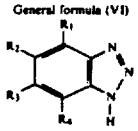

General formula (VII)

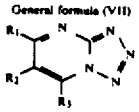

General formula (VIII)

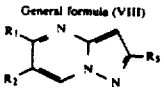

General formula (IX)

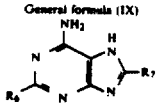

General formula (X)

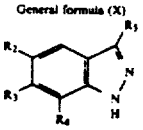

General formula (XI)

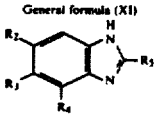

General formula (XII)

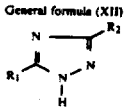

General formula (XIII)

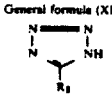

General formula (XIV)

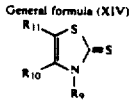

General formula (XV)

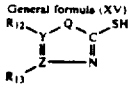

--

UNITED STATES PATENT AND TRADEMARK OFFICE

CERTIFICATE OF CORRECTION

PATENT NO. : 4,414,305

DATED : November 8, 1983

INVENTOR(S) : Koichi Nakamura; Hiroyuki Hirai

It is certified that error appears in the above-identified patent and that said Letters Patent is hereby corrected as shown below:

Column 29, line 28, after "atom," insert the following

-- wherein $R_1$, $R_2$, $R_3$ and $R_4$ each represents hydrogen, an alkyl group, an aralkyl group, an alkynyl group, an alkoxy group, an aryl group, —NRR'—, —COOR, —$SO_3M$, —CONRR', —$NHSO_2R$, —$SO_2NRR'$—, —$NO_2$, a halogen atom, —CN or —OH group, wherein R and R' are each hydrogen, an alkyl group, an aryl group and an aralkyl group, M is hydrogen and an alkyl metal atom; $R_5$ represents hydrogen, an alkyl group having from 1 to 5 carbon atoms and —S—R" group, wherein R" is hydrogen, an alkyl group, an aryl group and an aralkyl group; $R_6$ is hydrogen and an alkyl group; $R_7$ is hydrogen, an alkyl group and an aryl group; $R_8$ represents an alkyl group, an aryl group, a benzyl group, a pyridyl group; $R_9$ represents an alkyl group, an alkenyl group, and an aryl group; $R_{10}$ and $R_{11}$ represent an alkyl group, an alkenyl group and an aryl group; Q represents an oxygen atom, a sulfur atom or an —NR" group wherein R" is hydrogen, an alkyl group, an unsaturated alkyl group, or a substituted or unsubstituted aryl or aralkyl group; Y and Z each is a carbon atom or a nitrogen atom; and $R_{12}$ and $R_{13}$ each represents hydrogen, an alkyl group, an unsaturated alkyl group, a substituted or an unsubstituted aryl group, or a substituted or an unsubstituted aralkyl group, —SR"" and —$NH_2$ group, wherein R"" is hydrogen, an alkyl group, an aryl group, an aralkyl group, an alkylcarboxylic acid or an alkali metal salt thereof, an alkylsulfonic acid or an alkali metal salt thereof, --

Column 30, line 2, delete "(XIV)" and insert --(XV)--.

Signed and Sealed this

Fourth Day of November, 1986

[SEAL]

*Attest:*

DONALD J. QUIGG

*Attesting Officer* *Commissioner of Patents and Trademarks*